United States Patent [19]

Erikson et al.

[11] 4,205,987

[45] Jun. 3, 1980

[54] SULFONAMIDO PHENOL SCAVENGER COMPOUNDS

[75] Inventors: Wayne F. Erikson, Webster; Robert E. Ross, Rochester, both of N.Y.

[73] Assignee: Eastman Kodak Company, Rochester, N.Y.

[21] Appl. No.: 960,890

[22] Filed: Nov. 15, 1978

[51] Int. Cl.[2] ..... G03C 7/00; G03C 1/40; G03C 1/10; G03C 1/76

[52] U.S. Cl. ..... 430/216; 430/223; 430/243; 430/226; 430/503; 430/380; 430/566

[58] Field of Search ..... 96/56, 77, 95, 73, 74, 96/99, 100, 3, 29 D, 56.6

[56] References Cited

U.S. PATENT DOCUMENTS

| | | | |
|---|---|---|---|
| 2,336,327 | 12/1943 | Weissenberger et al. | 96/56 |
| 2,569,906 | 10/1951 | Starke | 96/56.6 |
| 3,403,721 | 10/1968 | Robins et al. | 164/43 |
| 3,459,548 | 8/1969 | Bloom et al. | 96/77 |
| 3,482,971 | 12/1969 | Bloom et al. | 96/56 |
| 3,582,333 | 6/1971 | Yost et al. | 96/56 |
| 3,597,474 | 8/1971 | Bloom et al. | 96/77 |
| 3,622,603 | 11/1971 | Bloom et al. | 96/77 |
| 3,635,707 | 1/1972 | Cole | 96/77 |
| 3,734,726 | 5/1973 | Figueras et al. | 96/77 |
| 3,779,756 | 12/1973 | Farran et al. | 96/77 |
| 3,930,862 | 1/1976 | Tsubota et al. | 96/77 |
| 4,076,529 | 2/1978 | Fleckenstein et al. | 96/77 |

OTHER PUBLICATIONS

"Oxidized Developer Scavenger . . . Latitude", Carges, *Research Disclosure,* No. 15234, Dec. 1976, pp. 19–20.

"Photographic Processes and Products, " *Research Disclosure,* No. 15162, Nov. 1975, pp. 75–87.

*Primary Examiner*—Richard L. Schilling

*Attorney, Agent, or Firm*—Harold E. Cole

[57] ABSTRACT

Photographic elements, film units and processes are described wherein certain ballasted di-2,5-sulfonamidophenols are used to scavenge oxidized electron transfer agents in color image transfer materials. The scavenger compounds can be located in an emulsion layer, a dye image-providing material layer or an interlayer.

36 Claims, No Drawings

SULFONAMIDO PHENOL SCAVENGER COMPOUNDS

This invention relates to photography, and more particularly to photographic assemblages for color diffusion transfer photography wherein certain ballasted di-2,5-sulfonamidophenols are used to scavenge oxidized electron transfer agents.

U.S. Pat. No. 4,076,529 of Fleckenstein et al, issued Feb. 28, 1978, describes various color image transfer elements which employ nondiffusible, redox-dye-releasing compounds which are alkali-cleavable upon oxidation to release a diffusible color-providing moiety. An electron transfer agent (ETA) is oxidized as a function of development. The $ETA_{ox}$ then cross-oxidizes the dye-releasing compound. Interlayers containing scavenging compounds, such as 2,5-di-sec-dodecylhydroquinone, are usually employed in these elements to prevent the ETA which is oxidized as a function of development of one emulsion layer from migrating to adjacent imaging layers where it would cause the "wrong" dye to be released. In the absence of an interlayer scavenger, severe color contamination would result in the final color image. Most scavenger compounds function by becoming oxidized by the oxidized ETA to regenerate the ETA. While certain compounds have been found to be useful for this purpose, compounds which are more effective and which exhibit little or no loss in scavenging efficiency upon long-term keeping are desired.

*Research Disclosure* 15162, November 1976, on page 83, discloses various scavengers for developer oxidation products in color diffusion transfer systems. Among the compounds described are "ballasted sulfonamidophenols and sulfonamidonaphthols without dye moieties attached thereto, e.g., 4-benzenesulfonamido-1-hydroxy-N-[4-(2,4-di-t-pentylphenoxy)butyl]-2-naphthamide". Phenols with two sulfonamido groups as described herein are not mentioned, however.

U.S. Pat. No. 2,336,327 relates to the use of aminophenols in an interlayer in photographic materials. U.S. Pat. Nos. 3,459,548 and 3,597,474 relate to the use of zwitterionic salts of p-aminophenols as scavengers for oxidized developer in certain color transfer systems. U.S. Pat. Nos. 3,482,971 and 3,622,603 describe the use of aminophenol derivatives as scavengers for oxidized developer in certain color transfer systems. U.S. Pat. No. 3,582,333 relates to the use of N-substituted p-aminophenol in an interlayer to reduce color fog formation and loss of speed. U.S. Pat. No. 3,930,862 relates to the use of catechols containing an alkylsulfonamido group as an auxiliary developer. U.S. Pat. No. 3,734,726 relates to the use of m-sulfonamidophenol dye releasers. U.S. Pat. No. 3,403,721 relates to the use of aminophenols in an overcoat layer of a photographic element to prevent color fog or stain. *Research Disclosure* 15234, December 1976, relates to the use of a developer scavenger combination comprising an aminophenol and a polyhydroxy benzene to improve processing temperature latitude in color transfer processes. These references, however, neither teach the use of the specific compounds described herein nor the improved results obtained therewith.

A photographic element in accordance with our invention comprises a support having thereon at least one photosensitive silver halide emulsion layer having associated therewith a dye image-providing material, and wherein the element contains a compound having the following formula:

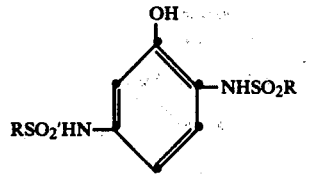

wherein each R represents a substituted or unsubstituted alkyl or aryl group, with the proviso that at least one R is of such molecular size and configuration as to render the compound nondiffusible in the photographic element during development in an alkaline processing composition.

In the above formula, each R can independently represent an alkyl group, including a substituted alkyl group, such as those having from 1 to about 40 carbon atoms, e.g., methyl, ethyl, isopropyl, butyl, pentyl, hydroxyethyl, decyl, dodecyl, etc; or an aryl group, including a substituted aryl group, such as those having from 6 to about 40 carbon atoms, e.g., phenyl, p-methoxyphenyl, p-sulfamoylphenyl, p-N-dodecylsulfamylphenyl, p-dodecylphenyl, 2,4-di-t-amylphenyl, 2-methoxy-4-octadecylphenyl, 4-phenoxyphenyl, o-dodecyloxy-p-tolyl, etc; so long as at least one R, or both R's in combination, is a ballast group, i.e., is of such molecular size and configuration as to render the compound nondiffusible in the photographic element during development in an alkaline processing composition.

In a preferred embodiment of the invention, each R can independently represent a phenyl group or a phenyl group substituted with additional substituents, such as substituted or unsubstituted alkyl, aryl, acyl, acylamino, alkoxy, aryloxy, sulfonamido, carbamoyl, sulfamoyl, sulfonyl and the like. Especially good results have been obtained when R is phenyl, $C_6H_4OC_{16}H_{33}$ or $C_6H_4OC_{12}H_{25}$.

Typical compounds included within the scope of the above formula include the following:

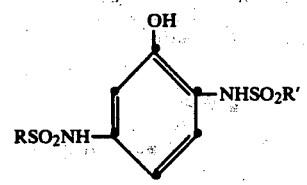

where R and R' are as follows:

| | R | R' |
|---|---|---|
| (1) | $C_6H_5$— | 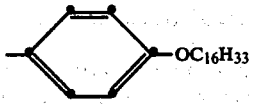  |

-continued
| | R | R' |
|---|---|---|
| (2) | $C_6H_5$— | 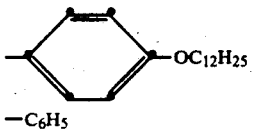 |
| (3) | 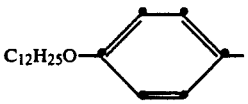 | —$C_6H_5$ |
| (4) | 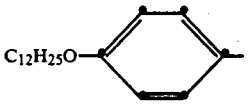 | 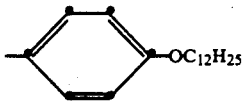 |
| (5) | 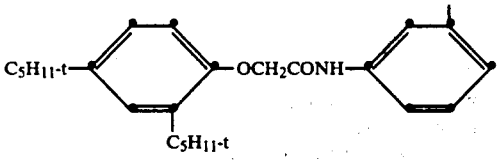 | —$C_6H_5$ |
| (6) | 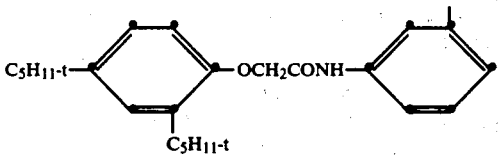 | 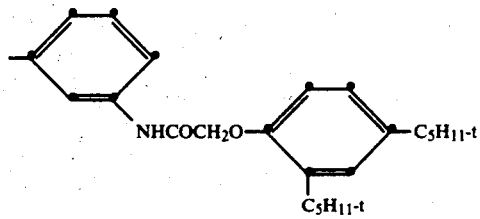 |
| (7) | $C_6H_5$— | 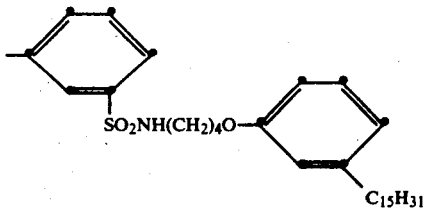 |
| (8) | 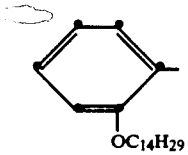 | 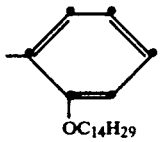 |
| (9) | $C_6H_5$— | 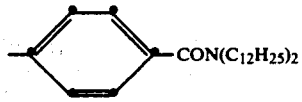 |
| (10) | 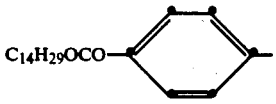 | 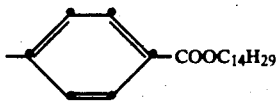 |
| (11) | $C_{16}H_{33}$— | —$C_{16}H_{33}$ |
| (12) | $C_6H_5$— | —$C_{16}H_{33}$ |
| (13) | 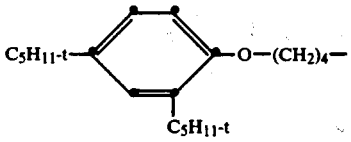 | 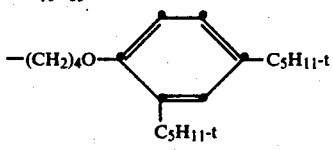 |
| (14) | $C_6H_5$— | 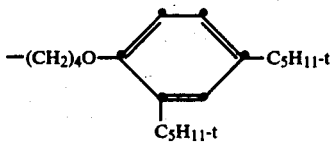 |
In a preferred embodiment of our invention, the scavenger compound is located in the photographic element in an interlayer between the various emulsion layers.

Such interlayers typically comprise the compound, gelatin, a coupler solvent and other usual addenda. The compound can be employed in any amount which is effective for the intended purpose. Good results have been obtained when the compound is employed in a coverage of from about 200 to 2,000 mg/m$^2$.

The compound, however, can also be located in other positions in the photographic element, such as in a silver halide emulsion layer or in the dye image-providing material layer. In these latter two locations, the compound could scavenge a portion of the oxidized developing agent before it can react with the dye image-providing material and therefore act as a competer for oxidized developer. Such competers are useful in diffusion transfer systems when development takes place at higher than optimum temperatures. For example, at high temperatures, such as 32° to 35° C., there can be excessive development, which causes more oxidized developing agent to be generated and more dye to be released. This will cause a significant loss in speed and an increase in $D_{max}$ and $D_{min}$. The presence of a competer will help to alleviate the problem somewhat by scavenging a portion of the oxidized developing agent to reduce the amount of dye released. The compound, when used as a competer, can be employed in any amount which is effective for the intended purpose. Good results have usually been obtained when the compound is employed in a coverage of from about 5 to 500 mg/m$^2$.

The dye image-providing material useful in our invention can be positive- or negative-working, and can be initially mobile or immobile in the photographic element during processing with an alkaline composition. Examples of initially mobile, positive-working dye image-providing materials useful in our invention are described in U.S. Pat. Nos. 2,983,606; 3,536,739; 3,705,184; 3,482,972; 2,756,142; 3,880,658 and 3,854,985. Examples of negative-working dye image-providing materials useful in our invention include conventional couplers which react with oxidized aromatic primary amino color developing agents to produce or release a dye such as those described, for example, in U.S. Pat. No. 3,227,550 and Canadian Pat. No. 602,607. In a preferred embodiment of our invention, the dye image-providing material is a ballasted, redox-dye-releasing (RDR) compound. Such compounds are well known to those skilled in the art and are generally speaking, compounds which will redox with oxidized developing agent or electron transfer agent to release a dye, such as by alkaline hydrolysis, or prevent the release of dye, such as by intramolecular nucleophilic displacement. Such nondiffusible RDR's can be positive-working compounds, as described in U.S. Pat. No. 3,980,479, British Pat. No. 1,464,104 and U.S. Pat. No. 4,139,379, issued Feb. 13, 1979. Such nondiffusible RDR's can also be negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; German Pat. Nos. 2,505,248 and 2,729,820; *Research Disclosure* 15157, November, 1976; and *Research Disclosure* 15654, April, 1977. In a more preferred embodiment of our invention, the nondiffusible RDR's are ballasted p-sulfonamidonaphthol compounds, each of which has a color-providing moiety attached thereto through a sulfonamido group which is alkali-cleavable upon oxidation.

A process for producing a photographic image in color according to our invention comprises:

treating an imagewise-exposed photographic element, as described above, with an alkaline processing composition in the presence of a silver halide developing agent to effect development of each exposed silver halide emulsion layer, whereby:

(a) an imagewise distribution of dye is formed as a function of the development of the silver halide emulsion layer; and (b) at least a portion of the imagewise distribution of the dye diffuses out of the element, such as to a dye image-receiving layer.

A process for producing a photographic image in color according to our invention using a preferred element as described above wherein the nondiffusible RDR is a ballasted compound having a color-providing moiety attached thereto through a sulfonamido group which is alkali-cleavable upon oxidation comprises:

treating said element which has been imagewise-exposed with an alkaline processing composition in the presence of a silver halide developing agent to effect development of each exposed silver halide emulsion layer, whereby:

(a) the developing agent becomes oxidized;

(b) the oxidized developing agent cross-oxidizes the sulfonamido compound;

(c) the oxidized sulfonamido compound then cleaves, thus forming an imagewise distribution of the color-providing moiety as a function of the development of the silver halide emulsion layer; and (d) at least a portion of the imagewise distribution of the color-providing moiety diffuses out of the element, such as to a dye image-receiving layer.

It will be appreciated that, after processing the photographic elements described above, there remains in the elements, after transfer has taken place, an imagewise distribution of dye in addition to developed silver. A color image comprising residual nondiffusible compound may be obtained in these elements if the residual silver and silver halide are removed in any conventional manner well known to those skilled in the photographic art, such as a bleach bath followed by a fix bath, a bleach-fix bath, etc. The imagewise distribution of dye may also diffuse out of these elements into these baths, if desired, rather than to an image-receiving element.

The photographic element in the above-described processes can be treated with an alkaline processing composition to effect or initiate development in any manner. A preferred method for applying processing composition is by use of a rupturable container or pod which contains the composition. In general, the processing composition employed in this invention contains the developing agent for development, although the composition could also be solely an alkaline solution where the developer is incorporated in the photographic element, the image-receiving element or the process sheet, in which case the alkaline solution serves to activate the incorporated developer.

A photographic film unit or assemblage in accordance with this invention is adapted to be processed by an alkaline processing composition, and comprises:

(1) a photographic element as described above; and (2) a dye image-receiving layer.

In this embodiment, the processing composition may be inserted into the film unit, such as by interjecting processing solution with communicating members similar to hypodermic syringes which are attached either to a camera or camera cartridge. The processing composition may also be applied by means of a swab or by dipping in a bath, if so desired.

In a preferred embodiment of the invention, the assemblage itself contains the alkaline processing composition and means containing same for discharge within the film unit, such as a rupturable container which is adapted to be positioned during processing of the film unit so that a compressive force applied to the container by pressure-applying members, such as would be found in a camera designed for in-camera processing, will effect a discharge of the container's contents within the film unit.

The dye image-receiving layer in the above-described film unit can be located on a separate support adapted to be superposed on the photographic element after exposure thereof. Such image-receiving elements are generally disclosed, for example, in U.S. Pat. No. 3,362,819. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

The dye image-receiving layer in the above-described film unit can also be located integral with the photographic element between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention can be employed is disclosed in Belgian Pat. No. 757,959. In this embodiment, the support for the photographic element is transparent and is coated with the image-receiving layer, a substantially opaque, light-reflective layer and the photosensitive layer or layers described above. A rupturable container, containing an alkaline processing composition and an opacifier, is positioned between the top layer and a transparent cover sheet which has thereon a neutralizing layer and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Belgian Pat. No. 757,959.

Still other useful integral formats in which this invention can be employed are described in U.S. Pat. Nos. 3,415,644; 3,415,645; 3,415,646; 3,647,437; and3,635,707. In most of these formats, a photosensitive silver halide emulsion is coated on an opaque support, and a dye image-receiving layer is located on a separate transparent support superposed over the layer outermost from the opaque support. In addition, this transparent support also preferably contains a neutralizing layer and a timing layer underneath the dye image-receiving layer.

Another embodiment of the invention uses the image-reversing technique disclosed in British Pat. No. 904,364, page 19, lines 1 through 41. In this process, the dye-releasing compounds are used in combination with physical development nuclei in a nuclei layer contiguous to the photosensitive silver halide negative emulsion layer. The film unit contains a silver halide solvent, preferably in a rupturable container with the alkaline processing composition.

The film unit or assembly of the present invention may be used to produce positive images in single-or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous to the silver halide emulsion layer, i.e., the dye image-providing material may be coated in a separate layer underneath the silver halide emulsion layer with respect to the exposure direction.

The concentration of the dye image-providing material that is employed in the present invention may be varied over a wide range, depending upon the particular compound employed and the results desired. For example, the dye image-providing material may be coated in a layer at a concentration of 0.1 to 3 $g/m^2$. The dye image-providing material may be dispersed in a hydrophilic film-forming natural material or synthetic polymer, such as gelatin, polyvinyl alcohol, etc, which is adapted to be permeated by aqueous alkaline processing composition.

A variety of silver halide developing agents can be employed in this invention. Specific examples of developers or ETA compounds which can be employed in this invention include hydroquinone compounds, such as hydroquinone, 2,5-dichlorohydroquinone, 2-chlorohydroquinone and the like; aminophenol compounds, such as 4-aminophenol, N-methylaminophenol, N,N-dimethylaminophenol, 3-methyl-4-aminophenol, 3,5-dibromoaminophenol and the like; catechol compounds, such as catechol, 4-cyclohexylcatechol, 3-methoxycatechol, 4-(N-octadecylamino)catechol and the like; phenylenediamine compounds, such as N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine and the like. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone, 5-methyl-3-pyrazolidinone, and the like. A combination of different ETA's, such as those disclosed in U.S. Pat. No. 3,039,869, can also be employed. Such developing agents can be employed in the liquid processing composition or may be contained, at least in part, in any layer or layers of the photographic element or film unit to be activated by the alkaline processing composition, such as in the silver halide emulsion layers, the dye image-providing material layers, interlayers, image-receiving layer, etc.

In using dye image-providing materials in the invention which produce diffusible dye images as a function of development, either conventional negative-working or direct-positive silver halide emulsions may be employed. If the silver halide emulsion employed is a direct-positive silver halide emulsion, such as an internal-image emulsion designed for use in the internal image reversal process, or a fogged, direct-positive emulsion such as a solarizing emulsion, which is developable in unexposed areas, a positive image can be obtained on the dye image-receiving layer by using ballasted, redox, dye-releasers. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a pH-lowering layer in the film unit or image-receiving unit lowers the pH of the film unit or image receiver to stabilize the image.

Internal-image silver halide emulsions useful in this invention are described more fully in the November 1976 edition of *Research Disclosure,* pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention can be of the type disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Any material can be employed as the image-receiving layer in this invention as long as the desired function of mordanting or otherwise fixing the dye images is obtained. The particular material chosen will, of course, depend upon the dye to be mordanted. Suitable materials are disclosed on pages 80 through 82 of the November 1976 edition of *Research Disclosure,* the disclosure of which is hereby incorporated by reference.

Use of a pH-lowering material in the film units of this invention will usually increase the stability of the transferred image. Generally, the pH-lowering material will effect a reduction in the pH of the image layer from about 13 or 14 to at least 11 and preferably 5 to 8 within a short time after imbibition. Suitable materials and their functions are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the pH-lowering layer which "times" or controls the pH reduction as a function of the rate at which the alkaline composition diffuses through the inert spacer layer. Examples of such timing layers and their functions are disclosed in the *Research Disclosure* articles mentioned in the paragraph above concerning pH-lowering layers.

The alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November 1976 edition of *Research Disclosure,* the disclosure of which is hereby incorporated by reference.

The alkaline solution-permeable, substantially opaque, light-reflective layer employed in certain embodiments of photographic film units used in this invention are described more fully in the November 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone.

The silver halide emulsions useful in this invention, both negative-working and direct-positive ones, are well known to those skilled in the art and are described in *Product Licensing Index,* Volume 92, December 1971, publication 9232, page 107, paragraph I, "Emulsion types"; they may be chemically and spectrally sensitized as described on page 107, paragraph III, "Chemical sensitization", and pages 108 and 109, paragraph XV, "Spectral sensitization", of the above article; they can be protected against the production of fog and can be stabilized against loss of sensitivity during keeping by employing the materials described on page 107, paragraph V, "Antifoggants and stabilizers", of the above article; they can contain development modifiers, hardeners, and coating aids as described on pages 107 and 108, paragraph IV, "Development modifiers"; paragraph VII, "Hardeners"; and paragraph XII, "Coating aids", of the above article; they and other layers in the photographic elements used in this invention can contain plasticizers, vehicles and filter dyes described on page 108, paragraph XI, "Plasticizers and lubricants", and paragraph VIII, "Vehicles", and page 109, paragraph XVI, "Absorbing and filter dyes", of the above article; they and other layers in the photographic elements used in this invention may contain addenda which are incorporated by using the procedures described on page 109, paragraph XVII, "Methods of addition", of the above article; and they can be coated by using the various techniques described on page 109, paragraph XVIII, "Coating procedures", of the above article, the disclosure of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers so long as the materials are accessible to one another.

The following examples ar provided to further illustrate the invention.

EXAMPLE 1

Preparation of Compound 4

STEP 1:

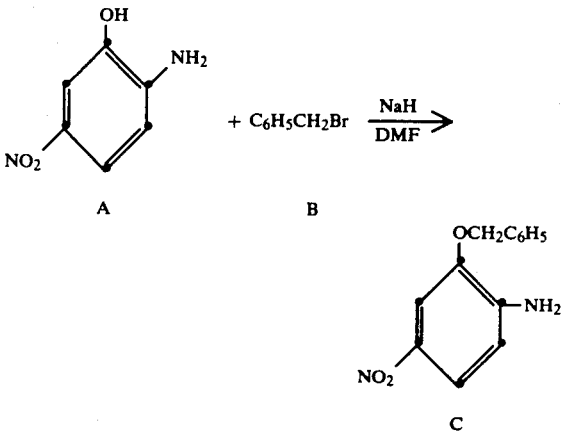

A stirred mixture of 57 percent oil dispersed sodium hydride (10.0 g, 0.237 mole) in 400 ml of dimethylformamide was treated with the solid aminophenol A (36.6 g, 0.237 mole). The temperature rose from 26° C. to about 40° C. After stirring for one-half hour, gas was still being evolved at the rate of about one bubble per second, and the temperature had fallen to 34° C. α-Bromotoluene (41.0 g, 0.240 mole) was added dropwise over a 15-minute period, causing the temperature to rise to about 40° C. After one-half hour, the color of the solution had become lighter and it was neutral to pH paper. Water (1 liter) was added to the stirred solution and the solid which separated was collected and washed with water. The yellow needles and brown lumps were recrystallized with $EtOH/CH_3CN$ (750/50 ml) (filtered hot) to give 34.6 g (59.6 percent) of bright yellow powder, m.p. 143°-148° C. The mother liquors gave a second crop which was recrystallized with EtOH to give 2.9 g of yellow platelets, m.p. 143° to 148° C.

STEP 2:

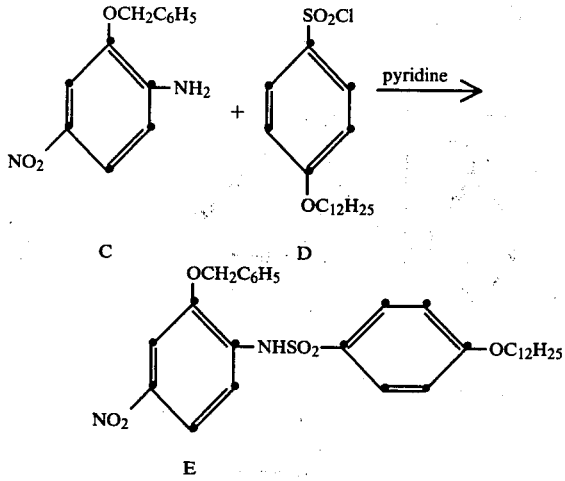

A stirred solution of the aniline C (12.2 g, 0.050 mole) in 100 ml of pyridine was chilled in an ice-acetone bath before the addition of the solid sulfonyl chloride D (18.0 g, 0.050 mole). After stirring overnight at ambient temperature, Thin Layer Chromatography (TLC) still shows starting material. The mixture (a solid coated the sides of the flask) was heated to reflux. After one hour, TLC showed no starting material and only one spot. The solution was allowed to cool somewhat, then poured onto ice (about 400 ml) and concentrated HCl (100 ml). An oil separated and gradually solidified into amber lumps. The supernate was very cloudy and filtration was very slow. The still damp solid was recrystallized with EtOH (about 200 ml) with charcoal to give 17.6 g (62.0 percent) of tan-colored solid, m.p. 83° to 86° C.

| | C | H | N | S |
|---|---|---|---|---|
| Calculated for $C_{31}H_{40}N_2O_6S$: | 65.5 | 7.1 | 4.9 | 5.6 |
| Found: | 65.2 | 7.2 | 4.9 | 6.1 |

STEP 3:

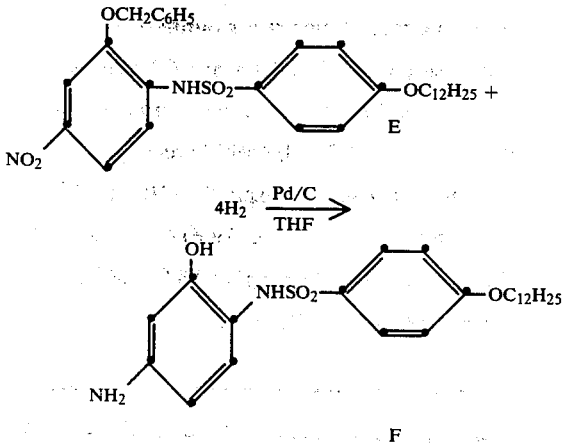

A Parr bottle was charged with the nitro ether E (28.4 g, 0.050 mole), 1.5 g of Pd/C catalyst, 200 ml of tetrahydrofuran (THF) and shaken under $H_2$ at an initial pressure of 35 psi. Hydrogen uptake was rapid; dropping to 22 psi in about 1 hour, 19 psi in about 3 hours. The mixture was shaken overnight and the pressure remained at 19 psi; for an uptake of 16 psi. The catalyst was removed by filtration, and the clear colorless filtrate was concentrated on a rotary evaporator to give 23.9 g (106 percent) of white powder, m.p. 132° to 135° C. Recrystallization with $CH_3CN$ (150 ml) gave 20.6 g (91.8 percent) of white powder, m.p. 133° to 136° C.

| | C | H | N | S |
|---|---|---|---|---|
| Calculated for $C_{24}H_{36}N_2O_4S$: | 64.3 | 8.1 | 6.2 | 7.1 |
| Found: | 64.1 | 8.7 | 6.4 | 8.4 |

STEP 4:

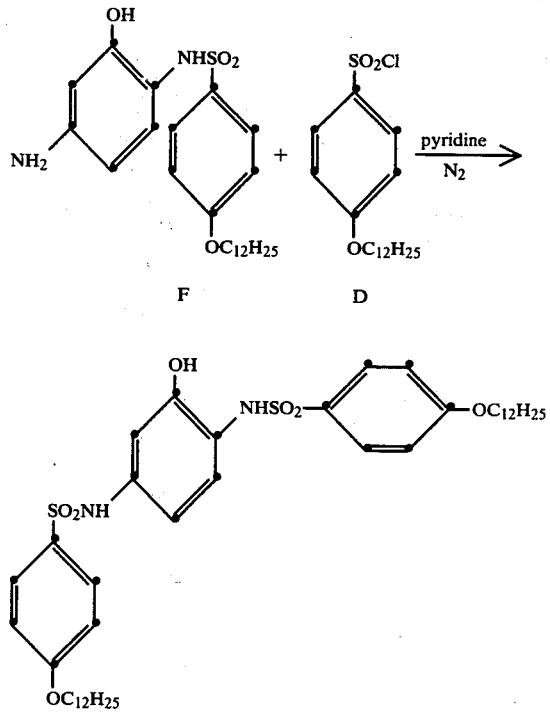

Compound 4

A stirred mixture of the aniline F (8.97 g, 0.020 mole) in 50 ml of pyridine at room temperature was flushed with $N_2$ before the addition of the solid sulfonyl chloride (7.22 g, 0.020 mole). The mixture warmed slightly, turned pink and all the solids dissolved. After about 15 minutes, a solid separated and soon a cake formed and stopped the stirrer. After standing for two days, the mixture was poured onto ice (200 ml) and concentrated HCl (50 ml). The solid which separated was collected and air-dried to give 17.0 g (>100 percent) of pink powder, m.p. 150° to 160° C. Recrystallization with $CH_3CN$ (300 ml) with charcoal gave 12.8 g (82.8 percent) of off-white powder, m.p. 188° to 190° C.

| | C | H | N | S |
|---|---|---|---|---|
| Calculated for $C_{42}H_{64}N_2O_7S_2$: | 65.3 | 8.3 | 3.6 | 8.3 |
| Found: | 65.5 | 8.9 | 3.8 | 8.7 |

EXAMPLE 2

Preparation of Compound 5

STEP 1:

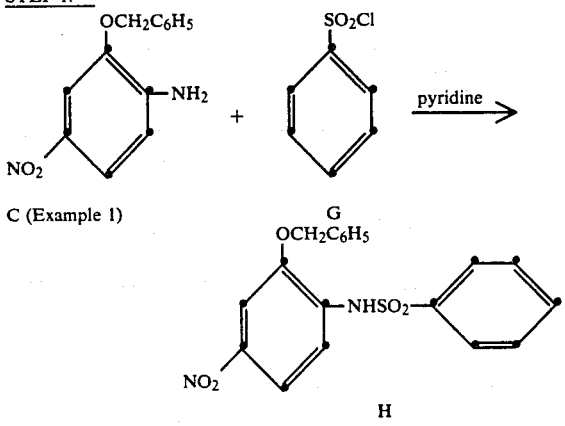

A stirred solution of the aniline C (Example 1) (12.2 g, 0.050 mole) in 100 ml of pyridine was chilled in an ice-acetone bath before the addition (all at once) of benzenesulfonyl chloride (8.8 g, 0.050 mole). After stirring overnight at ambient temperature, TLC shows mainly starting materials. The mixture (a solid coated the sides of the flask) was heated to reflux. After one hour, TLC shows no sulfonyl chloride. The solution was cooled slightly and poured onto ice (about 400 ml) and concentrated HCl (100 ml). The gum separated and soon solidified when rubbed. The solid was collected and recrystallized from isopropyl alcohol (600 ml) with charcoal to give 13.5 g (70.3 percent) of pale yellow platelets, m.p. 139° to 145° C.

| | C | H | N | S |
|---|---|---|---|---|
| Calculated for $C_{19}H_{16}N_2O_5S$: | 59.4 | 4.2 | 7.3 | 8.3 |
| Found: | 59.6 | 4.2 | 7.5 | 8.6 |

STEP 2:

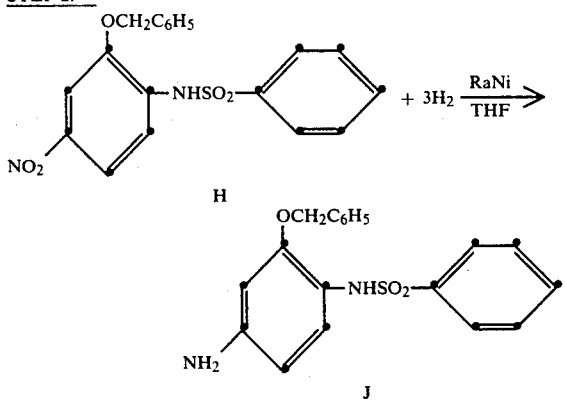

A Parr bottle was charged with the nitro compound H (24.1 g, 0.063 mole), 3 spoonulas of THF-washed Raney Nickel, 200 ml of THF and shaken under $H_2$ at an initial pressure of 36 psi. After about 3½ hours, the pressure had dropped to 21 psi. After 4 hours, it was 20 psi. The catalyst was removed by filtration and the pale yellow filtrate concentrated on a rotary evaporator. The resulting grayish-yellow solid was recrystallized with $CH_3OH/CH_3CN$ (250/25 ml) with charcoal to give 13.3 g (59.6 percent) of gray crystals, m.p. 157° to 159° C.

STEP 3:

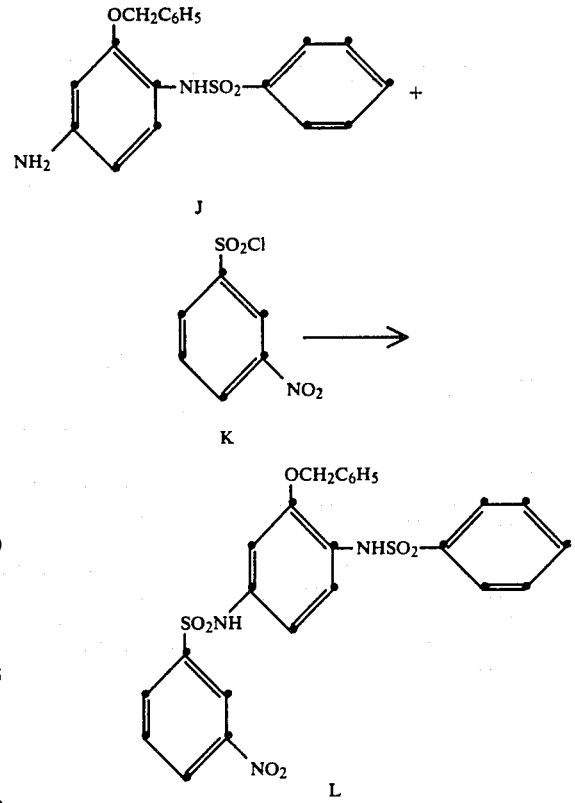

A stirred solution of the aniline J (13.3 g, 0.037 mole) in 100 ml of pyridine was flushed with $N_2$ and chilled in an ice bath before the addition of the solid sulfonyl chloride H (8.32 g, 0.037 mole). After stirring overnight, the dark red solution was poured onto ice (300 ml) and concentrated HCl (100 ml) and the resulting red solid was collected. Recrystallization with $CH_3OH/CH_3CN$ (250/25 ml) with charcoal gave 12.0 g (60.1 percent) of red spars, m.p. 198° to 200° C. Repeat recrystallization with $CH_3OH/CH_3CN/DMF$ (200/200/25 ml), filtered hot to give 7.6 g (38.0 percent) of yellow needles, m.p. 206° to 209° C.

| | C | H | N | S |
|---|---|---|---|---|
| Calculated for $C_{25}H_{21}N_3O_7S_2$: | 55.6 | 3.9 | 7.8 | 11.9 |
| Found: | 56.3 | 3.8 | 8.0 | 12.3 |

STEP 4:

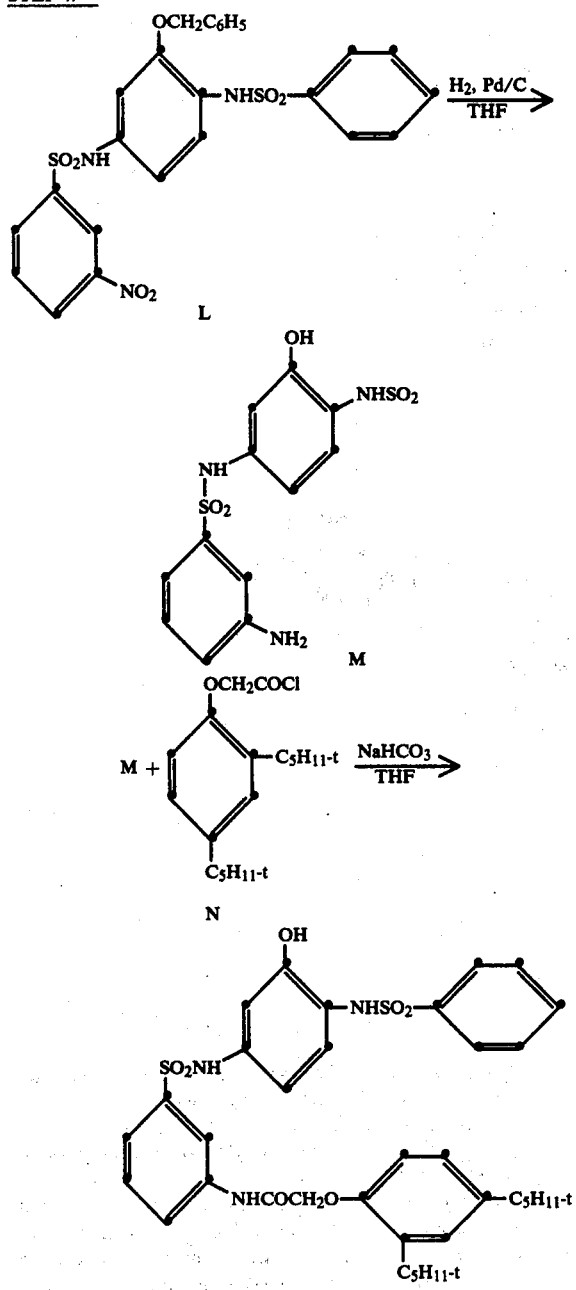

Compound 5

A Parr bottle was charged with the nitro compound L (5.40 g, 0.010 mole), 2 to 3 g of Pd/C catalyst, 100 ml of THF and shaken under $H_2$ at an initial pressure of 33 psi; after 10 minutes, the pressure had dropped to 13 psi; refilled to 31 psi; after 15 minutes, it was 25 psi; after 90 minutes, 20 psi; after shaking overnight, it was 16 psi. The catalyst was removed by filtration, and the clear, faintly pink filtrate was treated with $NaHCO_3$ (2.0 g, 0.024 mole) and the acid chloride N (3.11 g, 0.010 mole). After 1 hour, gas evolution had stopped. The mixture was poured into water (250 ml) and ether (100 ml). The water layer was discarded. The ether layer was again washed with water (250 ml) plus a few drops of acetic acid to aid separation, then dried ($MgSO_4$), charcoaled, filtered and concentrated on a rotary evaporator to give a pink oil. After standing for 2 days, the pink gum was dissolved in $CH_3CN$ (50 ml), seeded with some solid obtained in a test tube and allowed to stand at room temperature. After 1 week, filtration gave 2.1 g (30.2 percent for the two steps) of white powder, m.p. 188° to 191° C. The material was recrystallized with $CH_3CN$ (25 ml) to give 0.75 g (10.8 percent) of white powder, m.p. 204° to 207° C.

| | C | H | N | S |
|---|---|---|---|---|
| Calculated for $C_{36}H_{43}N_3O_7S_2$: | 62.3 | 6.2 | 6.1 | 9.2 |
| Found: | 62.5 | 6.5 | 5.9 | 9.7 |

EXAMPLE 3

Preparation and Photographic Testing of Integral Imaging Receiving Element

To evaluate compounds with respect to their effectiveness as interlayer scavengers for oxidized developing agent, the following two-color image transfer elements were prepared by coating the following layers in the order recited on a transparent poly(ethylene terephthalate) film support. Quantities are parenthetically given in g/m$^2$, unless otherwise stated.

(1) image-receiving layer of a poly(divinylbenzene-co-styrene-co-N-benzyl-N,N-dimethyl-N-vinylbenzyl-)ammonium chloride latex mordant (2.29) and gelatin (2.29);

(2) reflecting layer of titanium dioxide (16.2) and gelatin (2.59);

(3) opaque layer of carbon black (1.89) and gelatin (1.24);

(4) cyan dye-providing layer of gelatin (1.22), cyan RDR Compound A (0.54), and 1,4-cyclohexylenedimethylenebis(2-ethylhexanoate) (0.27);

(5) red-sensitive, direct-positive silver bromide emulsion (silver - 1.30, gelatin - 1.35), 2-(2-octadecyl-5-sulfohydroquinone potassium salt (0.17), 1-[4-(2-formylhydrazino)phenyl]-3-phenylthiourea (3.84 mg/mole of silver), and aceto-2-{p-[5-amino-2-(2,4-di-t-pentylphenoxy)benzamido]-phenyl}hydrazide (328 mg/mole of silver)

(6) interlayer of gelatin (2.16) and scavenger compounds* 1, 2, 3, 4, as shown above, and Prior Art Scavenger A ($1.6\times10^{-4}$ moles/m$^2$); and

* Each scavenger was dissolved in an equal weight of 1,4-cyclohexylenedimethylene-bis(2-ethylhexanoate) and dispersed in the gelatin before coating.

(7) yellow dye-providing layer of gelatin (1.46), yellow RDR Compound B (0.64); and 1,4-cyclohexylenedimethylene-bis(2-ethylhexanoate) (0.32).

CYAN RDR COMPOUND A

-continued

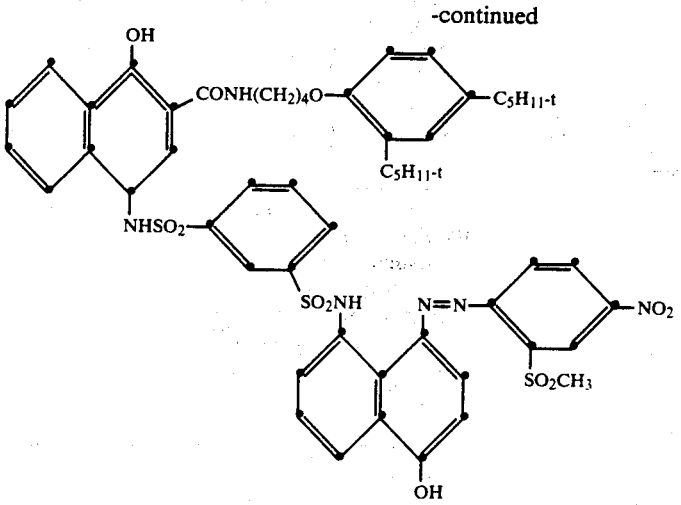

YELLOW RDR COMPOUND B

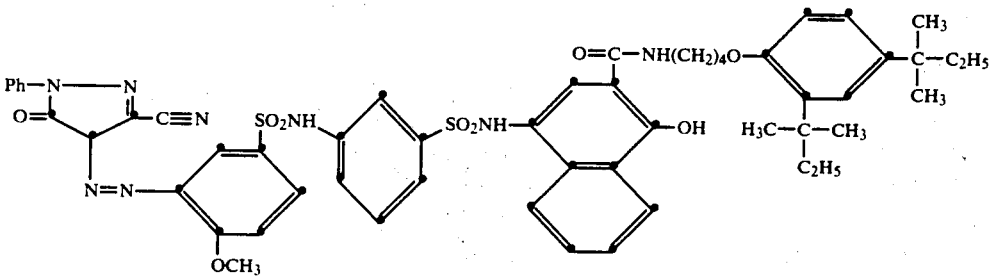

PRIOR ART SCAVENGER A

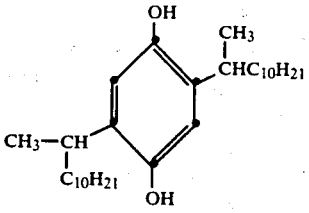

One sample of each of the above-prepared photosensitive elements was exposed through a graduated-density test object. The exposed samples were then processed at 70° F. (21° C.) by rupturing a pod containing a viscous processing composition between the photosensitive element and a transparent cover sheet, as described below.

The processing composition was as follows:

| | |
|---|---|
| Potassium hydroxide | 65.0 g |
| Sodium sulfite | 1.0 g |
| 5-Methylbenzotriazole | 3.8 g |
| 4-Hydroxymethyl-4-methyl-1-phenyl-3-pyrazolidone | 12.0 g |
| Potassium fluoride | 10.0 g |
| t-Butylhydroquinone | 0.3 g |
| Methylhydroquinone | 0.1 g |
| Carbon dispersion | 172.0 g Carbon |
| Carboxymethyl cellulose | 44.0 g |
| Water to 1.0 liter | |

The cover sheet consisted of a transparent poly(ethylene terephthalate) film support having coated thereon:

(1) a polyacrylic acid layer (188 meq/m$^2$)

(2) a timing layer comprising 2.16 g/m$^2$ of a mixture of 89 percent cellulose acetate (40 percent acetyl) and 11 percent poly(styrene-comaleic anhydride) (approximately 50 percent hydrolyzed)

(3) a second timing layer comprising 2.16 g/m$^2$ of a latex dispersion of poly(acrylonitrile-covinylidene chloride-co-acrylic acid)

Additional samples of each photosensitive element were incubated for two weeks and four weeks at 120° F. (48.8° C.) and 50 percent relative humidity in a pure oxygen atmosphere. This served as an accelerated test to represent room temperature keeping for about six months and about one year, respectively. After incubating, the samples were exposed and processed as described above.

The effectiveness of compounds 1, 2, 3 and 4 as interlayer scavengers for oxidized ETA relative to Prior Art Scavenger A was determined by measuring the amount of yellow dye contamination (blue density) in the final cyan (red density) image, before and after incubation. An effective scavenger for oxidized ETA must be sufficiently reactive to prevent color contamination, yet not be so reactive as to result in significant loss to the image dye density.

The results for each of the tested compounds are shown in the following table, wherein the red $D_{max}$ indicates the maximum amount of cyan image dye transferred to the receiving layer, and the values stated for blue $D_{max}$ have been corrected to exclude the unwanted blue absorption of the cyan dye so as to represent the amount of yellow dye contamination caused by the yellow RDR in the indicating layer of the model elements.

TABLE I

| Element with Scavenger Compound | Red $D_{max}$ Fresh | Red $D_{max}$ 2-wk inc. | Red $D_{max}$ 4-wk inc. | Blue $D_{max}$ Fresh | Blue $D_{max}$ 2-wk inc. | Blue $D_{max}$ 4-wk inc. |
|---|---|---|---|---|---|---|
| None (control) | 1.75 | 1.89 | 1.92 | 0.80 | 0.84 | 0.88 |
| A (control) | 1.44 | 1.88 | 2.12 | 0.04 | 0.45 | 0.78 |
| 1 | 1.39 | 1.67 | 1.74 | 0.05 | 0.07 | 0.09 |
| 2 | 1.52 | 1.75 | 1.80 | 0.08 | 0.11 | 0.07 |
| 3 | 1.66 | 1.87 | 1.88 | 0.04 | 0.05 | 0.03 |
| 4 | 1.98 | 1.82 | 1.92 | 0.00 | 0.06 | 0.05 |

In the control element which has no interlayer scavenger, the oxidized developing agent (4-hydroxymethyl-4-methyl-1-phenyl-3-pyrazolidone) migrated to the yellow RDR layer, reacted with the RDR to release a diffusible yellow dye, which then caused the relative high blue density values. When the compounds of the invention were used as scavengers, however, the blue densities were significantly reduced relative to the control elements, thus indicating that they were highly effective in scavenging the oxidized developing agent, both in the fresh samples and after incubation.

The invention has been described in detail with particular reference to preferred embodiments thereof, but it will be understood that variations and modifications can be effected within the spirit and scope of the invention.

What is claimed is:

1. In a photographic element to be processed with an electron transfer agent comprising a support having thereon at least one photosensitive silver halide emulsion layer having associated therewith a dye image-providing material comprising a ballasted, redox-dye-releasing compound, the improvement wherein said element also contains a scavenger compound having the following formula:

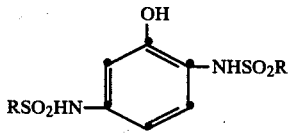

wherein each R represents a substituted or unsubstituted alkyl or aryl group, with the proviso that at least one R is of such molecular size and configuration as to render said compound nondiffusible in said photographic element during development in an alkaline processing composition, said scavenger compound being capable of being oxidized by reacting with oxidized electron transfer agent to regenerate said electron transfer agent, said scavenger compound being separate and distinct from said dye image-providing material.

2. The photographic element of claim 1 wherein said scavenger compound is located in said silver halide emulsion layer.

3. The photographic element of claim 1 wherein said scavenger compound is located in a layer with said dye image-providing material.

4. The photographic element of claim 1 wherein said dye-releasing compound is a p-sulfonamidonaphthol.

5. The photographic element of claim 1 wherein said element comprises at least two photosensitive silver halide emulsion layers, said scavenger compound being located in an interlayer between said emulsion layers.

6. The photographic element of claim 1 wherein each R is phenyl, $C_6H_4OC_{16}H_{33}$ or $C_6H_4OC_{12}H_{25}$.

7. The photographic element of claim 6 wherein said scavenger compound is:

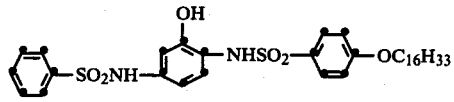

8. The photographic element of claim 6 wherein said scavenger compound is:

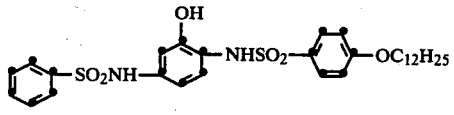

9. The photographic element of claim 6 wherein said scavenger compound is:

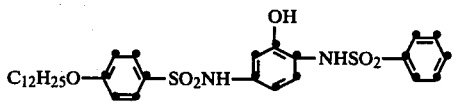

10. The photographic element of claim 6 wherein said scavenger compound is:

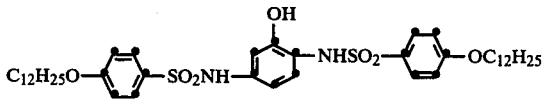

11. In a photographic element to be processed with an electron transfer agent comprising a support having thereon a red-sensitive silver halide emulsion layer having associated therewith a cyan dye image-providing material comprising a ballasted, redox, cyan dye-releasing compound, an interlayer, a green-sensitive silver halide emulsion layer having associated therewith a magenta dye image-providing material comprising a ballasted, redox, magenta dye-releasing compound, an interlayer, and a blue-sensitive silver halide emulsion layer having associated therewith a yellow dye image-providing material comprising a ballasted, redox, yellow dye-releasing compound, the improvement wherein each said interlayer comprises a scavenger compound having the following formula:

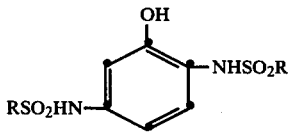

wherein each R represents a substituted or unsubstituted alkyl or aryl group, with the proviso that at least one R is of such molecular size and configuration as to render said compound nondiffusible in said photographic element during development in an alkaline processing composition, said scavenger compound being capable of being oxidized by reacting with oxidized electron transfer agent to regenerate said electron transfer agent, and said scavenger compound being separate and distinct from said dye image-providing materials.

12. The photographic element of claim 11 wherein said dye-releasing compound is a p-sulfonamidonaphthol.

13. The photographic element of claim 11 wherein each R is phenyl, $C_6H_4OC_{16}H_{33}$ or $C_6H_4OC_{12}H_{25}$.

14. In a photographic assemblage to be processed with an electron transfer agent, said assemblage comprising:

(a) a photographic element comprising a support having thereon at least one photosensitive silver halide emulsion layer having associated therewith a dye image-providing material comprising a ballasted, redox-dye-releasing compound; and (b) a dye image-receiving layer;

the improvement wherein said photographic element also contains a scavenger compound having the following formula:

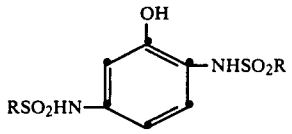

wherein each R represents a substituted or unsubstituted alkyl or aryl group, with the proviso that at least one R is of such molecular size and configuration as to render said compound nondiffusible in said photographic element during development in an alkaline processing composition, said scavenger compound being capable of being oxidized by reacting with oxidized electron transfer agent to regenerate said electron transfer agent, said scavenger compound being separate and distinct from said dye image-providing material.

15. In a photographic assemblage comprising:

(a) a photographic element comprising a support having thereon at least one photosensitive silver halide emulsion layer having associated therewith a dye image-providing material comprising a ballasted, redox-dye-releasing compound;

(b) a dye image-receiving layer; and (c) an alkaline processing composition and means containing same for discharge within said assemblage;

said assemblage containing an electron transfer agent; the improvement wherein said photographic element also contains a scavenger compound having the following formula:

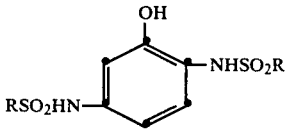

wherein each R represents a substituted or unsubstituted alkyl or aryl group, with the proviso that at least one R is of such molecular size and configuration as to render said compound nondiffusible in said photographic element during development in an alkaline processing composition, said scavenger compound being capable of being oxidized by reacting with oxidized electron transfer agent to regenerate said electron transfer agent, said scavenger compound being separate and distinct from said dye image-providing material.

16. The photographic assemblage of claim 15 wherein said scavenger compound is located in said silver halide emulsion layer.

17. The photographic assemblage of claim 15 wherein said scavenger compound is located in a layer with said dye image-providing material.

18. The photographic assemblage of claim 15 wherein said dye-releasing compound is a p-sulfonamidonaphthol.

19. The photographic assemblage of claim 15 wherein said element comprises at least two photosensitive silver halide emulsion layers, said scavenger compound being located in an interlayer between said emulsion layers.

20. The photographic assemblage of claim 15 wherein each R is phenyl, $C_6H_4OC_{16}H_{33}$ or $C_6H_4OC_{12}H_{25}$.

21. In a photographic assemblage comprising:

(a) a photographic element comprising a support having thereon a red-sensitive silver halide emulsion layer having associated therewith a cyan dye image-providing material comprising a ballasted, redox, cyan dye-releasing compound, an interlayer, a green-sensitive silver halide emulsion layer having associated therewith a magenta dye image-providing material comprising a ballasted, redox, magenta dye-releasing compound, an interlayer, and a blue-sensitive silver halide emulsion layer having associated therewith a yellow dye image-providing material comprising a ballasted, redox, yellow dye-releasing compound;

(b) a dye image-receiving layer; and (c) an alkaline processing composition and means containing same for discharge within said assemblage;

said assemblage containing an electron transfer agent; the improvement wherein each said interlayer comprises a scavenger compound having the formula:

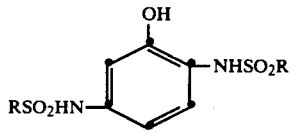

wherein each R represents a substituted or unsubstituted alkyl or aryl group, with the proviso that at least one R is of such molecular size and configuration as to render said compound nondiffusible in said photographic element during development in an alkaline processing composition, said scavenger compound being capable of being oxidized by reacting with oxidized electron transfer agent to regenerate said electron transfer agent, and said scavenger compound being separate and distinct from said dye image-providing materials.

22. The photographic assemblage of claim 15 wherein:

(a) said dye image-receiving layer is located between said support and said silver halide emulsion layer; and (b) said assemblage also includes a transparent cover sheet over the layer outermost from said support.

23. The photographic assemblage of claim 22 wherein said cover sheet has thereon, in sequence, a neutralizing layer and a timing layer.

24. The photographic assemblage of claim 23 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

25. The photographic assemblage of claim 15 wherein said support having thereon said photosensitive silver halide emulsion layer is opaque and said dye image-receiving layer is located on a separate transparent support superposed over the layer outermost from said opaque support.

26. The photographic assemblage of claim 25 wherein said transparent support has thereon, in sequence, a neutralizing layer, a timing layer and said dye image-receiving layer.

27. In an integral photographic assemblage comprising:

(a) a photosensitive element comprising a transparent support having thereon the following layers in sequence: a dye image-receiving layer, an alkaline solution-permeable, light-reflective layer, an alkaline solution-permeable, opaque layer, a red-sensitive silver halide emulsion layer having associated therewith a cyan dye image-providing material comprising a ballasted, redox, cyan dye-releasing compound, an interlayer, a green-sensitive silver halide emulsion layer having associated therewith a magenta dye image-providing material comprising a ballasted, redox, magenta dye-releasing compound, an interlayer, and a blue-sensitive silver halide emulsion layer having associated therewith a yellow dye image-providing material comprising a ballasted, redox, yellow dye-releasing compound;

(b) a transparent sheet superposed over said blue-sensitive silver halide emulsion layer and comprising a transparent support having thereon, in sequence, a neutralizing layer and a timing layer; and (c) a rupturable container containing an alkaline processing composition and an opacifying agent which is so positioned during processing of said assemblage that a compressive force applied to said container will effect a discharge of the container's contents between said transparent sheet and said blue-sensitive silver halide emulsion layer;

said assemblage containing an electron transfer agent; the improvement wherein each said interlayer comprises a scavenger compound having the formula:

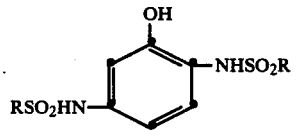

wherein each R represents a substituted or unsubstituted alkyl or aryl group, with the proviso that at least one R is of such molecular size and configuration as to render said compound nondiffusible in said photographic element during development in an alkaline processing composition, said scavenger compound being capable of being oxidized by reacting with oxidized electron transfer agent to regenerate said electron transfer agent, and said compound being separate and distinct from said dye image-providing materials.

28. In a process for producing a photographic image in color in an imagewise-exposed photographic element comprising a support having thereon at least one photosensitive silver halide emulsion layer having associated therewith a dye image-providing material comprising a ballasted, redox-dye-releasing compound, said process comprising:

treating said element with an alkaline processing composition in the presence of an electron transfer agent to effect development of each exposed silver halide emulsion layer, whereby:

(a) an imagewise distribution of said dye is formed as a function of said development of said silver halide emulsion layer; and (b) at least a portion of said imagewise distribution of said dye diffuses out of said element, the improvement wherein said process is performed in the presence of a scavenger compound having the following formula:

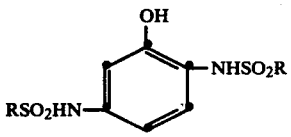

wherein each R represents a substituted or unsubstituted alkyl or aryl group, with the proviso that at least one R is of such molecular size and configuration as to render said compound nondiffusible in said photographic element during development in an alkaline processing composition, said scavenger compound being oxidized by reacting with oxidized electron transfer agent to regenerate said electron transfer agent, and said scavenger compound being separate and distinct from said dye image-providing material.

29. The process of claim 28 wherein said image-wise distribution of said dye diffuses to a dye image-receiving layer.

30. The process of claim 28 wherein said scavenger compound is located in said silver halide emulsion layer.

31. The process of claim 28 wherein said scavenger compound is located in a layer with said dye image-providing material.

32. The process of claim 28 wherein said scavenger dye-releasing compound is a p-sulfonamidonaphthol.

33. The process of claim 28 wherein said element comprises at least two photosensitive silver halide emulsion layers, said scavenger compound being located in an interlayer between said emulsion layers.

34. The process of claim 28 wherein each R is phenyl, $C_6H_5OC_{16}H_{33}$ or $C_6H_4OC_{12}H_{25}$.

35. The process of claim 28 wherein said photographic element comprises a support having thereon a red-sensitive silver halide emulsion layer having associated therewith a cyan dye image-providing material comprising a ballasted, redox, cyan dye-releasing compound, an interlayer, a green-sensitive silver halide emulsion layer having associated therewith a magenta dye image-providing material comprising a ballasted, redox, magenta dye-releasing compound, an interlayer, and a blue-sensitive silver halide emulsion layer having associated therewith a yellow dye image-providing material comprising a ballasted, redox, yellow dye-releasing compound, and said scavenger compound is located in each said interlayer.

36. A process for preventing color contamination in an imagewise-exposed photographic element comprising a support having thereon at least one photosensitive silver halide emulsion layer having associated therewith a dye image-providing material comprising a ballasted, redox-dye-releasing compound, said process comprising reacting with an oxidized electron transfer agent, generated as a result of development of said element, a scavenger compound having the following formula:

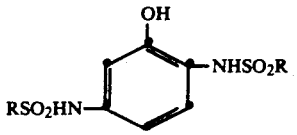

wherein each R represents a substituted or unsubstituted alkyl or aryl group, with the proviso that at least one R is of such molecular size and configuration as to render said compound nondiffusible during development in an alkaline processing composition, said scavenger compound being separate and distinct from said dye image-providing material, whereby said scavenger compound is oxidized to regenerate said electron transfer agent.

* * * * *